US006235462B1

(12) United States Patent
Takamuki

(10) Patent No.: US 6,235,462 B1
(45) Date of Patent: May 22, 2001

(54) THERMALLY DEVELOPABLE PHOTOSENSITIVE MATERIAL

(75) Inventor: Yasuhiko Takamuki, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/493,357

(22) Filed: Jan. 28, 2000

(30) Foreign Application Priority Data

Feb. 3, 1999 (JP) ..... 11-026113

(51) Int. Cl.[7] ..... G03C 1/498
(52) U.S. Cl. ..... 430/619; 430/620
(58) Field of Search ..... 430/619, 620, 430/617

(56) References Cited

U.S. PATENT DOCUMENTS 6,074,814 * 6/2000 Deroover et al. ..... 430/619
6,083,680 * 7/2000 Ito et al. ..... 430/619

* cited by examiner

*Primary Examiner*—Thorl Chea
(74) *Attorney, Agent, or Firm*—Jordan B. Bierman; Bierman, Muserlian and Lucas

(57) ABSTRACT

A thermally developable photosensitive material is disclosed, comprising a support having thereon an image forming layer containing an organic silver salt and optionally provided on the side of the image forming layer, a component layer, at least one of the image forming layer and the component containing photosensitive silver halide grains and the photosensitive material exhibiting a silver potential of not more than 200 mV.

10 Claims, No Drawings

THERMALLY DEVELOPABLE PHOTOSENSITIVE MATERIAL

FIELD OF THE INVENTION

The present invention relates to thermally developable photosensitive material forming images through thermal development, and in particular to thermally developable photosensitive materials having a image forming layer coated by using an aqueous coating solution and exhibiting reduced fogging even when allowed to stand under a high humid atmosphere.

BACKGROUND OF THE INVENTION

Recently, in the field of printing plate making and medical treatments, effluents produced in wet process of image forming materials produce problems in working property, and reduction of the effluents is strongly desired in terms of environment protection and saving space. In response thereto, techniques of photothermal materials capable of forming sharp and clear black images on thermal development are needed. Such a technique is described in D. Morgan, "Dry Silver Photographic Materials" in Handbook of Imaging Materials, published by Marcel Dekker Inc. (1991) at page 48. The photographic materials described therein are developed at a temperature of 80° C. or higher and called a thermally developable photosensitive material.

However, it has been known that such a type of thermally developable photosensitive materials easily produce marked fog when allowed to stand in an atmosphere at a high humidity for a long period of time, leading to unfavorable results. In almost of the thermally developable photosensitive materials, a coating solution using organic solvents such as toluene, methyl ethyl ketone or methanol is coated to form a image forming layer. This is because polyvinyl acetal such as polyvinyl butyral used as a binder is soluble only in organic solvents. However, the use of an organic solvent is disadvantageous in terms of bad influences on human body in the manufacturing process and costs for recovering the solvent.

JP-A 49-562626, 50-151138, 53-116144, 58-28737 and 60-61747 (hereinafter, the term, JP-A means an unexamined, published Japanese Patent Application) describe a technique for forming the image forming layer by using a coating solution containing an aqueous solvent, in which aqueous soluble binders such as gelatin, polyvinyl alcohol and polyvinyl acetal are employed. Further, JP-A 10-73899 and 10-73901 describes a image forming layer containing a binder such as an aqueous-dispersible acryl type polymer or aqueous dispersible-dispersible polyvinyl acetal. The use of such a binder enables to form the image forming layer by using an aqueous solvent type coating solution, leading to merits in environment and cost. However, in cases where the image forming layer is formed using an aqueous coating solution, problems of fogging caused upon storage over a long period of time in atmosphere at high humidity become prominent. Further, it is desired to make the image forming layer thinner.

SUMMARY OF THE INVENTION

Accordingly, an object of the present invention is to provide thermally developable photosensitive materials of which image forming layer can be formed by coating an aqueous coating solution having advantages in environment protection and cost, and which exhibit a low fogging level even upon storage at a high humidity.

Another object of the invention is to provide a thermally developable photosensitive material exhibiting superior performance even when the image forming layer is made thinner.

The object of the present invention can be accomplished by the following constitution:

(1) A thermally developable photosensitive material comprising a support, an image forming layer containing an organic silver salt and optionally provided on the side of the image forming layer, a component layer, wherein at least one of the image forming layer and the component contains photosensitive silver halide grains; and after 10,000 $mm^2$ of the thermally developable photosensitive material is immersed in 100 ml of a liquid dispersing medium maintained at a temperature of 40° C. for a period of 60 min., the immersed photosensitive material is removed therefrom and the remaining liquid dispersing medium exhibits a silver potential of not more than 200 mV at 40° C., in which at least 30% by weight of the liquid dispersing medium is accounted for water;

(2) The thermally developable photosensitive material described in (1), wherein at least one of the image forming layer and the component layer contains a reducing agent or a precursor thereof;

(3) The thermally developable photosensitive material described in (1), wherein the image forming layer is formed by coating a coating solution for the image forming layer; at least 30% by weight of a liquid dispersing medium contained in the coating solution being water and the coating solution exhibiting a silver potential of not more than 200 mV;

(4) The thermally developable photosensitive material described in (1), wherein the image forming layer is formed by coating a coating solution of the image forming layer and drying it, at least 30% by weight of a liquid medium of the coating solution of the image forming layer being accounted for an organic solvent (5) The thermally developable photosensitive material described in (1), wherein the organic silver salt is a silver salt of a polymer represented by the following formula (0):

$$—(X)x—(Y)y— \qquad \text{Formula (0)}$$

wherein X is a repeating unit derived from a monomer containing an acid group; Y is a repeating unit derived from a monomer except for X; x and y represent contents of X and Y, respectively, x is 5 to 95% by weight and y is 5 to 95% by weight, provided that the sum of x and y is 100%;

(6) The thermally developable photosensitive material described in (5), wherein in the silver salt of the polymer, at least 95% of the acid group of the polymer form a silver salt;

(7) The thermally developable photosensitive material described in (5), wherein the silver salt of the polymer is a silver salt of a polymer represented by the following formula $$—(A)a—(B)b— \qquad \text{Formula (1)}$$

wherein A is a repeating unit derived from an ethylenically unsaturated monomer containing a carboxy group; B is a repeating unit derived from an ethylenically unsaturated monomer except for A; a and b represent contents of A and B, respectively, a is 5 to 95% by weight and b is 5 to 95%, provided that the sum of a and b is 100%;

(8) The thermally developable photosensitive material described in (5), wherein the image forming layer contains the silver salt of a polymer represented by the following formula (0) in an amount of not less than 50% by weight of the image forming layer and the image forming layer further containing a binder in an amount of less than 50% by weight of the image forming layer;

(9) The thermally developable photosensitive material described in (8), wherein the thickness of the image forming layer is 1 to 10 $\mu$m;

(10) The thermally developable photosensitive material described in (1), wherein the organic silver salt is a silver salt of a polymer obtained by polyaddition of a carboxy-containing dihydric compound and a diisocyanate compound;

(11) A method for preparing a thermally developable photosensitive material comprising a support, an image forming layer, and optionally provided on the side of the image forming layer, a component layer, in which at least one of the image forming layer and the component layer contains photosensitive silver halide grains, the method comprising: coating a coating solution to form an image forming layer wherein the coating solution comprises an organic silver salt and a liquid dispersing medium, at least 30% by weight of the liquid dispersing medium being water;

(12) A thermally developable photosensitive material comprising a support having one side thereof a photosensitive layer containing photosensitive silver halide grains, and further comprising an organic silver salt and a reducing agent capable of reducing the silver salt, wherein the photosensitive layer is formed by coating a coating solution, in which at least 30% by weight of a solvent is water and which exhibits a silver potential of not more than 200 mV;

(13) A thermally developable photosensitive material comprising a support having one side thereof a photosensitive layer containing photosensitive silver halide grains, and further comprising an organic silver salt and a reducing agent capable of reducing the silver salt, wherein the organic silver salt is a silver salt of a polymer containing an acid group of 5 to 95% by weight; and

(14) Thermally developable photosensitive material described in (13), wherein the organic silver salt is a silver salt of a polymer represented by the following formula (1):

$$—(A)a—(B)b— \qquad \text{Formula (1)}$$

wherein A is a repeating unit derived from an ethylenically unsaturated monomer containing a carboxy group; B is a repeating unit derived from an ethylenically unsaturated monomer except for A; a and b represent contents of A and B, respectively, a is 5 to 95% by weight and b is 5 to 95%, provided that the sum of a and b is 100%.

DETAILED DESCRIPTION OF THE INVENTION

The thermally developable photosensitive material according to the invention comprises a support having one side thereof an image forming layer containing an organic silver salt and optionally further having a photographic component layer. At least one of the image forming layer and the component layer contains photosensitive silver halide grains. Further, after 10,000 $mm^2$ of a thermally developable photosensitive material is allowed to be immersed in 100 ml liquid dispersing medium containing water of at least 30% by weight of the liquid dispersing medium and maintained at a temperature of 40° C. for a period of 60 min., the immersed photosensitive material is removed therefrom and the remaining liquid dispersing medium exhibits a silver potential of not more than 200 mV at 40° C. The silver potential can be determined by the commonly used method, as described later. The component layer used in the invention refers to a layer other than the image forming layer, including auxiliary layers such as a protective layer, sublayer, antistatic layer and a backing layer provided on the opposite side of the support to the image forming layer. The silver halide grains may be contained in the image forming layer, together with the organic silver salt, or in the component layer adjacent to the image forming layer. The silver halide grains are preferably contained in the image forming layer.

The reducing agent or its precursor may be contained in the image forming layer or a component layer (preferably, adjacent to the image forming layer).

In one of preferred embodiments of the invention, a silver salt of a polymer represented by the following formula (0) is employed as an organic silver salt used in the invention:

$$—(X)x—(Y)y— \qquad \text{Formula (0)}$$

wherein X is a repeating unit derived from a monomer containing an acid group; Y is a repeating unit derived from a monomer except for X; x and y represent contents of X and Y, respectively, x is 5 to 95% by weight and y is 5 to 95% by weight, provided that the sum of x and y is 100%. X ay be any one of repeating units derived from monomers containing an acid group. In his case, the repeating unit may be the sum of plural repeating units derived from plural monomers. Similarly, Y may be any one of repeating units derived from monomers containing an acid group, in which the repeating unit may be the sum of plural repeating units derived from plural monomers; x is 5 to 95% by weight, preferably 10 to 90% by weight, and more preferably 20 to 80% by weight.

The polymeric silver salt described above preferably accounts for 50 to 100% by weight (more preferably 70 to 100%, and still more preferably 90 to 100% by weight) of the organic silver salt contained in the image forming layer. The polymeric silver salt may be used alone or in combination with an organic silver salt such as silver behenate. In the polymeric silver salt, it is preferred that at least 95% (preferably at least 99%) of total acid groups contained in the polymer of formula (0) react with silver ions to form a silver salt.

The polymeric silver salt is further preferably a silver salt of a polymer represented by the following formula (1):

$$—(A)a—(B)b— \qquad \text{Formula (1)}$$

wherein A is a repeating unit derived from an ethylenically unsaturated monomer containing a carboxy group; B is a repeating unit derived from an ethylenically unsaturated monomer except for A; a and b represent contents of A and B, respectively, a is 5 to 95% by weight and b is 5 to 95%, provided that the sum of a and b is 100%. A ay be any one of repeating units derived from ethylenically unsaturated monomers containing an acid group. In his case, the repeating unit may be the sum of plural repeating units derived from plural ethylenically unsaturated monomers. Similarly, B may be any one of repeating units derived from ethylenically unsaturated monomers containing an acid group, in which the repeating unit may be the sum of plural repeating units derived from plural ethylenically unsaturated monomers.

In cases when a silver salt of the polymer represented by formula (0) is employed as an organic silver salt, it is preferred that this polymeric silver salt also plays a role as a binder of the image forming layer. Thus, it is preferred that the image forming layer contains the silver salt of a polymer represented by formula (0) and optionally a binder, and the polymeric silver salt accounting for at least 50% by weight (preferably at least 70% and more preferably 90% by weight) of the image forming layer. In this case, the content of the binder is preferably not more than 30% by weight, and more preferably not more than 10% by weight of the image forming layer. Such constitution advantageously makes the image forming layer thinner. The image forming layer is preferably 1 to 10 $\mu$m thick, and more preferably 2 to 8 $\mu$m thick.

Furthermore, the thermally developable photosensitive materials according used in the invention can be prepared according to the following process. Thus, on a support, a coating solution for an image forming layer is coated and dried to the image forming layer on the support. In this case, a component layer may be provided between the support and the image forming layer or on the image forming layer. When the coating solution for the image forming layer contains water of at least 30% by weight (preferably at least 60%) of a liquid dispersing medium, or even when the coating solution for the image forming layer contains an organic solvent of at least 30% by weight (preferably at least 60%) of a liquid dispersing medium, the thermally developable photosensitive material exhibits superior storage stability. Specifically, when at 30% by weight of the liquid dispersing medium is water, such an advantageous effect is marked. The organic solvent is preferably toluene, methyl ethyl ketone or methanol. Further, in cases where the image forming layer coating solution comprises an organic silver salt and a liquid dispersing medium, at least 30% by weight (preferably at least 50% and more preferably at least 70% by weight) of the liquid dispersing medium is preferably water and the coating solution preferably exhibits a silver potential of not more than 200 mV (preferably 0 to 200 mV, and more preferably 20 to 150 mV). This constitution markedly improves storage stability over a long period of time, even when using an aqueous coating solution. In this case, a polymeric silver salt, i.e., a silver salt of a polymer represented by formula (0) can be employed when a liquid dispersing medium of the coating solution is either water or an organic solvent.

Not more than 70% by weight (preferably less than 5% by weight) of the liquid medium of the coating solution may a water-miscible organic solvent. Examples of the water-miscible solvent include alcohols such as methanol, ethanol and propanol; celllosolve type solvents such as methyl cellosolve, ethyl cellosolve and butyl cellosolve; acetic acid ester type solvents such as methyl acetate and ethyl acetate; ketoamide type solvents such as dimethyl formamide and dimethyl acetoamide; carbonate type solvents such as dimethylcarbonate and diethylcarbonate; and ketone type solvents such as acetone and methyl ethyl ketone.

The silver potential of the coating solution of the image forming layer is not more than 200 mV. Herein, the silver potential is defined as a difference in electrode potential between a silver electrode (purity of 99.99% or more) and a reference electrode of Ag/AgCl when the silver electrode and the reference electrode which are joined through a salt bridge comprised of an aqueous 10% $KNO_3$ solution are brought into contact with the coating solution maintained at 40° C. The silver potential is preferably 0 to 200 mV and more preferably 25 to 150 mV. The silver potential of more than 200 mV tends to increase fogging and the silver potential of less than 0 mV causes reduction in sensitivity. The silver potential of the coating solution can be adjusted using a halide compound such as KCl, KBr, NaCl and NaBr; a nitrogen containing organic compound such as 5-methylbenzotriazole and 5-nitrobenzoindazole; and a mercapto compound such as 1-phenyl-5-mercaptotetrazole and sodium 1-mercaptobenzothiazole-5-sulfonate.

Organic silver salts used in the invention are reducible silver source, including silver salts of hetero-organic acid and acid polymer, which contain reducible silver ion source. There are also usable organic or inorganic silver complex salts containing a ligand exhibiting a total stability constant of 4.0 to 10.0. Examples of the silver salts are described in Research Disclosure No. 17243 and No. 29963, including salts of organic acids (e.g., salts of gallic acid, oxalic acid, behenic acid, stearic acid, palmitic acid, lauric acid); silver salts of carboxyalkylthiourea [e.g., 1-(3-carboxypropyl) thiourea, 1-(3-carboxypropyl)-3,3-dimethylthiourea; a silver complex of the polymer reaction product of an aldehyde and a hydroxy-substituted aromatic carboxylic acid (e.g., aldehydes such as formaldehyde, acetoaldehyde and butylaldehyde, and hydroxy-substituted acids such as salicylic acid, benzylic acid, 3,5-dihydroxybenzoic acid, and 5,5-thiodisalicylic acid); silver salts and their complex [e.g., 3-(2-carboxyethyl)-4-hydroxymethyl-4-thiazoline-2-thioene, 3-carboxymethyl-4-methyl-4-thiazoline-2-thioene]; salts or complexes of silver and a nitrogen acid selected from imidazole, pyrazole, urazole, 1H-tetrazole, 3-amino-5-benzylthio-1,2,4-triazole and benzotriazole; and silver salts of mercaptides.

Preferred organic silver salts used in the invention is a silver salts of a polymer containing 5 to 95% by weight of an acid group. Herein, the polymer containing 5 to 95% by weight of an acid group means that the polymer contains the repeating unit having an acid portion such as carboxylic acid, sulfonic acid or phosphoric acid as a branched chain structure of a polymer (main) chain, in a proportion of 5 to 95% by weight. Examples of the polymer chain include polyethylene type, polyamide type, polyester type and polyurethane type. There is also preferably used a polymer obtained by polyaddition of a carboxy-containing dihydric compound (i.e., a compound containing two hydroxy groups and a carboxy group) and a diisocyanate compound. Thus, this polymer is to be a kind of polyurethanes, which is characterized in that the polyurethane contains a carboxy group. Examples of the carboxy-containing dihydroxy-compound include 2,2-bis(hydroxymethyl)propionic acid, 2,2-bis(hydroxymethyl)-butanoic acid, 2,2-bis (hydroxyethyl)propionic acid, 2,2-bis(hydroxyethyl) butanoic acid, 2,2-bis(hydroxypropyl)-propionic acid and 2,2-bis(hydroxypropyl)butanoic acid. Examples of the diisocyanate compound include 4,4'-diphenylmethanediisocyanate, tolylene diisicyanate, hexamethylene diisocyanate and isophorone diisocyanate. The content of the carboxy-containing dihydroxy-compound is preferably 10 to 60% by eight, and more preferably 20 to 50% by weight. In addition to the components described above, the polymer may further contain a polyhydroxy-compound such as ethylene glycol, triethylene glycol, dimethylene glycol, glycerin, pentaerythritol, or sorbitol to adjust physical properties of the polyurethane or to form a three-dimensional structure. In this case, the polyhydroxy-compound is added preferably in an amount of 1 to 30%, and more preferably 5 to 20% by weight. Of these, a polymer represented by formula (1) described above is preferred:

In the formula (1), examples of monomers represented by A include acrylic acid, methacrylic acid, itaconic acid, maleic acid, fumaric acid, citraconic acid, styrenecarboxylic acid, 2-carboxyethyl acrylate and 2-carboxyethyl methacrylate. However, the monomers are not limited to these examples. The monomers may be used alone or in combination thereof. Specifically, acrylic acid and methacrylic acid are preferred.

Preferred monomers represented by B include acrylic acid ester type monomes, methacylic acid type monomers, styrenes and halogenated vinyls. Examples of the acrylic acid esters include methyl methacrylate, ethyl methacrylate, n-butyl acrylate, t-butyl acrylate, cyclohexyl acrylate, 2-ethylhexyl acrylate, isononyl acrylate, benzyl acrylate and phenyl acrylate. Examples of the methacrylic acid esters include methyl methacrylate, ethyl methacrylate, n-butyl methacrylate, t-butyl methacrylate, cylohexyl methacrylate, isononyl methacrylate, benzyl methacrylate, and phenyl methacrylate. Examples of the styrenes include styrene, o-methylstyrene, m-methylstyrene, p-methylstyrene, α-methylstyrene, p-tert-butylstyrene, and p-chlorostyrene. Examples of the halogenated vinyls include vinyl chloride and vinylidene chloride, but are not limited to these. These monomers mat be used alone or in combination thereof. Of the monomer described above, methyl methacrylate, t-butyl methacrylate, and styrene are preferred, and methyl methacrylate is more preferred.

Further, it is preferred that a monomer having two or more ethylenically unsaturated group and capable of cross- linking is contained as a part of the B component (herein, also denoted as C component). Examples of such a monomer having two or more ethylenically unsaturated group and capable of cross-linking include divinylbenzene, 4,4'-isopropylidene diphenylene diacrylate, 1,3-butylene diacrylate, 1,3-butylene dimethacrylate, 1,4-cyclohexylene dimethylene dimethacrylate, dimethylene glycol dimethacrylate, diisopropylidene glycol dimethacrylate, divinyl oxymethane, ethylene glycol dimethacrylate, ethylidene diacrylate, ethylidene dimethacrylate, 1,6-diacrylamidohexane, N,N'-methylene-bis-acrylamide, N,N'-(1,2-dihydroxy)methylene-bis-acrylamide, 2,2'-dimethyl-1,3-trimethylene dimethacrylate, phenylethylene dimethacrylate, tetraethylene glycol methacrylate, tetramethylene diacrylate, tetramethylene dimethacrylate, 2,2,2-trichloroethylidene dimethacrylate, triethylene glycol diacrylate, pentaerythritol triacrylate, trimethylolpropane triacrylate, tetramethylolmethane tetracrylate, triethylene glycol dimethacrylate, 1,3,5-triacryloylhexane-s-triazine, bisacrylamidoacetic acid, ethylidene trimethacrylate, propylidine triacrylate, and vinyl acryloxyacetate.

These monomers may be used alone or in combination thereof. Of these monomers, ethylene glycol dimethacrylate, divinylbenzene and N,N'-methylene-bis-acrylamide are preferred, and ethylene glycol dimethacrylate is more preferred.

In the formula (1), the content "a" is preferably 10 to 80% by weight, and more preferably 15 to 60% by weight; the content "b" is preferably 20 to 90% by eight, and more preferably 40 to 85% by weight. The content of the C component as a part of the B component is preferably 1 to 20% by weight, and more preferably 3 to 15% by weight.

Exemplary examples of the polymers represented by formula (1) are shown below, but are not limited to these examples (in which numerals represent % by weight).

P-1 methacrylic acid/styrene copolymer (30/70)

P-2 methacrylic acid/t-butyl acrylate (40/60)

P-3 methacrylic acid/hexyl acrylate (50/50)

P-4 methacrylic acid/2-ethylhexyl acrylate copolymer (40/60)

P-i methacrylic acid/phenyl acrylate copolymer (40/60)

P-6 methacrylic acid/cyclohexyl acrylate copolymer (40/60)

P-7 methacrylic acid/methyl methacrylate copolymer (20/80)

P-8 methacrylic acid/methyl methacrylate copolymer(30/70)

P-9 methacrylic acid/butyl methacrylate/cyclohexyl acrylate copolymer(40/20/40)

P-10 methacrylic acid/2-ethylhexyl methacrylate copolymer (40/60)

P-11 acrylic acid/styrene copolymer (20/80)

P-12 acrylic acid/hexyl acrylate (40/60)

P-13 acrylic acid/isononyl acrylate copolymer (40/60)

P-14 acrylic acid/2-ethylhexyl acrylate copolymer (60/40)

P-15 acrylic acid/phenyl acrylate copolymer (50/50)

P-16 itaconic acid/styrene copolymer (40/60)

P-17 itaconic acid/2-ethylhexyl acrylate copolymer (40/60)

P-18 itaconic acid/benzyl acrylate copolymer (40/60)

P-19 maleic acid/styrene copolymer (40/60)

P-20 maleic acid/hexyl acrylate copolymer (20/80)

P-21 maleic acid/phenyl acrylate copolymer (40/60)

P-22 methacrylic acid/methyl methacrylate/ethylene glycol dimethacrylate copolymer (40/50/10)

P-23 methacrylic acid/n-butyl acrylate/ethylene glycol dimethacrylate copolymer (30/60/10)

P-24 acrylic acid/methyl methacrylate/ethylene glycol dimethacrylate copolymer (30/60/10)

P-25 acrylic acid/methyl methacrylate/n-butyl acrylate/divinylbenzene copolymer (40/20/35/5)

P-26 acrylic acid/ethyl acrylate/methylene bis-acrylamide copolymer (40/55/5)

P-27 2,2-bis(hydroxymethyl)propionic acid/4,4'-diphenyl-Methane diisocyanate polycondensate (50/50)

P-28 2,2-bis(hydroxymethyl)butanoic acid/tolylene Diisocyanate polycondensate (50/50)

P-29 2,2-bis(hydroxymethyl9propionic acid/4,4'-diphenyl- methane diisocyanate/hexamethylene diisocynate/ triethylene glycol (40/35/10/15)

Among polymers described above, polyethylene type polymers can be obtained by the commonly known emulsion polymerization method. The emulsion polymerization method is detailed in S. Hirai "Chemistry of Polymer Latex" published by Kobunshi Kankokai (1970). The polyurethane type polymers can also be obtained by referring to the methods described in Gunter Oertel, Polyurethane Handbook 21, 1985; and S. Murahashi et al, Synthetic Polymer V at page 309–359.

The polymer used for the polymeric silver salts used in the invention is preferably a weight-averaged molecular weight of 1,000 to 100,000, and more preferably 3,000 to 50,000. The polymeric silver salts can be obtained by mixing an aqueous solution of the polymer described above and aqueous silver nitrate solution, using normal precipitation, reverse precipitation, double jet addition or controlled double jet addition described in JP-A 9-127643. It is preferred that prior to mixing, silver halide grains are added to an aqueous solution or dispersion of the polymer. The coverage of the polymeric silver salt is preferably 0.5 to 3 g $Ag/m^2$, and more preferably 0.8 to 2 g $Ag/m^2$.

Silver halide grains used in the invention function as a photosensor. To prevent milky white after image formation and to obtain superior image quality, smaller grains are preferred, and the average grain size is preferably not more than 0.2 $\mu$m, more preferably 0.03 to 0.15 $\mu$m, and still more preferably 0.03 to 0.11 $\mu$m. The grain size refers to the edge length of the grain in cases when silver halide grains are regular crystal such as cubic or octahedral form. In the case of non-regular crystal grains such as spherical-, bar-, or planar-form, the grain size is a diameter of a ball having the same volume as a silver halide grain.

The form of silver halide grains is not specifically limited, but the proportion accounted for by miller index {100} face is preferably high, more preferably not less than 50%, still more preferably not less than 70%, and optimally not less than 80%. The proportion of {100} face can be determined by the method described in T. Tani, J. Imaging Sci., 29, 165 (1985), in which difference in adsorption of sensitizing dyes between {111} face and {100} face was employed.

The halide composition of silver halide is not specifically limited and may be any one of silver chloride, silver chlorobromide, silver iodochlorobromide, silver bromide, silver iodobromide and silver iodide. Silver halide emulsions used in the invention can be prepared according to the methods described in P. Glafkides, Chimie Physique Photographique (published by Paul Montel Corp., 19679; G. F. Duffin, Photographic Emulsion Chemistry (published by Focal Press, 1966); V. L. Zelikman et al., Making and Coating of Photographic Emulsion (published by Focal Press, 1964). Any one of acidic precipitation, neutral precipitation and ammoniacal precipitation is applicable and the reaction mode of aqueous soluble silver salt and halide salt includes single jet addition, double jet addition and a combination thereof. Silver halide may be incorporated into the image forming layer by any means so that the silver halide is arranged so as to be close to reducible silver source. The silver halide may be formed by reaction of an organic silver salt and a halide ion to convert a part of the organic silver salt to silver halide. Alternatively, silver halide which has been prepared in advance may be added to a solution to prepare an organic silver salt. A combination of these may be applicable bur the latter is preferred. The content of silver halide is preferably 0.75 to 30% by weight, based on an organic silver salt.

Silver halide preferably occludes ions of metals belonging to Groups 6 to 11 of the Periodic Table. Preferred as the metals are W; Fe, Co, Ni, Cu, Ru, Rh, Pd, Re, Os, Ir, Pt and Au.

These metals may be introduced into silver halide in the form of a complex. In the present invention, regarding the transition metal complexes, six-coordinate complexes represented by the general formula described below are preferred:

Formula: $(ML_6)^m$:

wherein M represents a transition metal selected from elements in Groups 6 to 11 of the Periodic Table; L represents a coordinating ligand; and m represents 0, 1-, 2-, 3- or 4-. Exemplary examples of the ligand represented by L include halides (fluoride, chloride, bromide, and iodide), cyanide, cyanato, thiocyanato, selenocyanato, tellurocyanato, azido and aquo, nitrosyl, thionitrosyl, etc., of which aquo, nitrosyl and thionitrosyl are preferred. When the aquo ligand is present, one or two ligands are preferably coordinated. L may be the same or different.

The particularly preferred example of M is rhodium (Rh), ruthenium (Ru), rhenium (Re), iridium (Ir) or osmium (Os).

Exemplary examples of transition metal ligand complexes are shown below.

1: $[RhCl_6]^{3-}$
2: $[RuCl_6]^{3-}$
3: $[ReCl_6]^{3-}$
4: $[RuBr_6]^{3-}$
5: $[OsCl_6]^{3-}$
6: $[IrCl_6]^{4-}$
7: $[Ru\ (NO)\ Cl_5]^{2-}$
8: $[RuBr_4\ (H_2O)]^{2-}$
9: $[Ru\ (NO)\ (H_2O)\ Cl_4]$
10: $[RhCl_5\ (H_2)]^{2-}$
11: $[Re(NO)\ Cl_5]^{2-}$
12: $[Re\ (NO)\ CN_5]^{2-}$
13: $[Re(NO)\ Cl\ (CN)_4]^{2-}$
14: $[Rh\ (NO)_2Cl_4]^-$
15: $[Rh\ (NO)\ (H_2O)\ Cl_4]^-$
16: $[Ru(NO)\ (CN)_5]^{2-}$
17: $[Fe(CN)_6]^{3-}$
18: $[Rh(NS)\ Cl_5]^{2-}$
19: $[Os\ (NO)\ Cl_5]^{2-}$
20: $[Cr(NO)\ Cl_5]^{2-}$
21: $[Re(NO)\ Cl_5]^-$
22: $[Os\ (NS)\ Cl_4\ (TeCN)]^{2-}$
23: $[Ru(NS)\ Cl_5]^{2-}$
24: $[Re(NS)\ Cl_4(SeCN)]^{2-}$
25: $[Os(NS)\ Cl(SCN)_4]^{2-}$
26: $[Ir(NO)\ Cl_5]^{2-}$
27: $[Ir(NS)\ Cl_5]^{2-}$

One type of these metal ions or complex ions may be employed and the same type of metals or the different type of metals may be employed in combinations of two or more types. Generally, the content of these metal ions or complex ions is suitably between $1\times10^{-9}$ and $1\times10^{2-}$ mole per mole of silver halide, and is preferably between $1\times10^{8-}$ and $1\times10^{4-}$ mole.

Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation.

These compounds may be added several times by dividing the added amount. Uniform content in the interior of a silver halide grain can be carried out. As disclosed in JP-A No. 63-29603, 2-306236, 3-167545, 4-76534, 6-110146, 5-273683, the metal can be distributively occluded in the interior of the grain.

These metal compounds can be dissolved in water or a suitable organic solvent (for example, alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be placed in a reaction vessel immediately after grain formation, or during physical ripening or at the completion thereof or during chemical ripening.

Reducing agents are preferably incorporated into the thermally developable photosensitive material of the present invention. Examples of suitable reducing agents are described in U.S. Pat. Nos. 3,770,448, 3,773,512, and 3,593,863, and Research Disclosure Items 17029 and 29963, and include the following: aminohydroxycycloalkenone compounds (for example, 2-hydroxypiperidino-2-cyclohexane); esters of amino reductones as the precursor of reducing agents (for example, piperidinohexose reducton monoacetate); N-hydroxyurea derivatives (for example, N-p-methylphenyl-N-hydroxyurea); hydrazones of aldehydes or ketones (for example, anthracenealdehyde phenylhydrazone; phosphamidophenols; phosphamidoanilines; polyhydroxybenzenes (for example, hydroquinone, t-butylhydroquinone, isopropylhydroquinone, and (2,5-dihydroxy-phenyl)methylsulfone); sulfydroxamic acids (for example, benzenesulfhydroxamic acid); sulfonamidoanilines (for example, 4-(N-methanesulfonamide)aniline); 2-tetrazolylthiohydroquinones (for example, 2-methyl-5-(1-phenyl-5-tetrazolylthio)hydroquinone); tetrahydroquinoxalines (for example, 1,2,3,4-tetrahydroquinoxaline); amidoxines; azines (for example, combinations of aliphatic carboxylic acid arylhydrazides with ascorbic acid); combinations of polyhydroxybenzenes and hydroxylamines, reductones and/or hydrazine; hydroxamic acids; combinations of azines with sulfonamidophenols; α-cyanophenylacetic acid derivatives; combinations of bis-β-naphthol with 1,3-dihydroxybenzene derivatives; 5-pyrazolones, sulfonamidophenol reducing agents, 2-phenylindane-1,3-dione, etc.; chroman; 1,4-dihydropyridines (for example, 2,6-dimethoxy-3,5-dicarboethoxy-1,4-dihydropyridine); bisphenols (for example, bis(2-hydroxy-3-t-butyl-5-methylphenyl)methane, bis(6-hydroxy-m-tri)mesitol, 2,2-bis(4-hydroxy-3-methylphenyl)propane, 4,5-ethylidene- bis(2-t-butyl-6-methyl)phenol, UV-sensitive ascorbic acid derivatives and 3-pyrazolidones. Of these, particularly preferred reducing agents are hindered phenols. As hindered phenols, listed are compounds represented by the general formula (A) described below:

Formula (A)

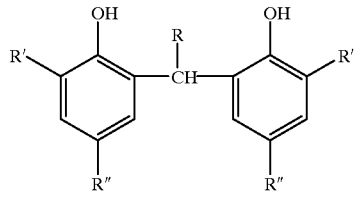

wherein R represents a hydrogen atom or an alkyl group having from 1 to 10 carbon atoms (for example, —$C_4H_9$, 2,4,4-trimethylpentyl), and R' and R" each represents an alkyl group having from 1 to 5 carbon atoms (for example, methyl, ethyl, t-butyl).

Exemplary examples of the compounds represented by the formula (A) are shown below.

A-1

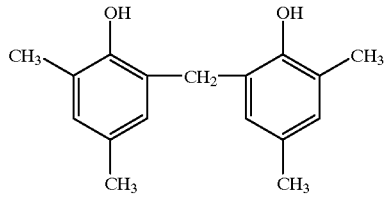

A-2

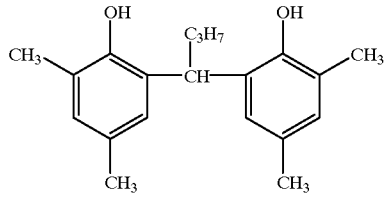

A-3

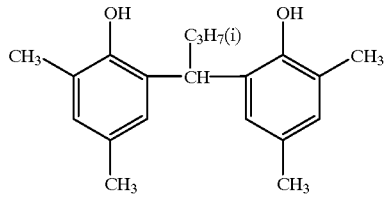

A-4

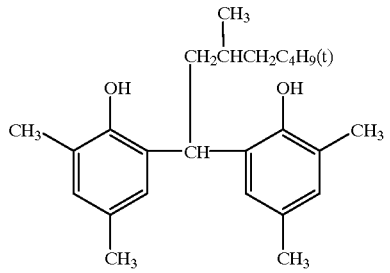

A-5

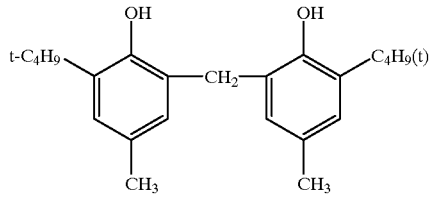

-continued

A-6

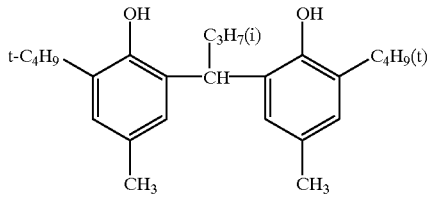

A-7

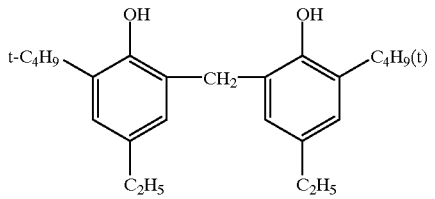

The used amount of reducing agents represented by the above-mentioned general formula (A) is preferably between $1\times10^{-2}$ and 10 moles, and is more preferably between $1\times10^{-2}$ and 1.5 moles per mole of silver.

Polymers contained in the polymeric silver salts preferably play a role of a binder used in the thermally developable materials, but the following materials may be incorporated as a binder. Binders suitable for the thermally developable photosensitive material to which the present invention is applied are transparent or translucent, and generally colorless. Binders are natural polymers, synthetic resins, and polymers and copolymers, other film forming media; for example, gelatin, gum arabic, poly(vinyl alcohol), hydroxyethyl cellulose, cellulose acetate, cellulose acetatebutylate, poly(vinylpyrrolidone), casein, starch, poly(acrylic acid), poly(methylmethacrylic acid), poly(vinyl chloride), poly (methacrylic acid), copoly(styrene-maleic acid anhydride), copoly(styrene-acrylonitrile, copoly(styrene-butadiene, poly (vinyl acetal) series (for example, poly(vinyl formal)and poly(vinyl butyral), poly(ester) series, poly(urethane) series, phenoxy resins, poly(vinylidene chloride), poly(epoxide) series, poly(carbonate) series, poly(vinyl acetate) series, cellulose esters, poly(amide) series. These may be hydrophilic or hydrophobic. Of these polymers are preferred polacrylic acid esters such as polymethyl methacrylate, copolystyrene butadiene, polyvinyl acetals, cellulose esters and polyurethanes. In the present invention, the amount of the binder in a photosensitive layer is preferably between 1.5 and 6 g/m$^2$, and is more preferably between 1.7 and 5 g/m$^2$. The binder content of less than 1.5 g/m$^2$ tends to increase a density of unexposed area to levels unacceptable to practical use.

In the present invention, a matting agent is preferably incorporated into the image forming layer side. In order to minimize the image abrasion after thermal development, the matting agent is provided on the surface of a photosensitive material and the matting agent is preferably incorporated in an amount of 0.5 to 10 per cent in weight ratio with respect to the total binder in the emulsion layer side.

Materials of the matting agents employed in the present invention may be either organic substances or inorganic substances. Regarding inorganic substances, for example, those can be employed as matting agents, which are silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc. Regarding organic substances, as organic matting agents those can be employed which are starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169.

The shape of the matting agent may be crystalline or amorphous. However, a crystalline and spherical shape is preferably employed. The size of a matting agent is expressed in the diameter of a sphere which has the same volume as the matting agent. The particle diameter of the matting agent in the present invention is referred to the diameter of a spherical converted volume. The matting agent employed in the present invention preferably has an average particle diameter of 0.5 to 10 $\mu$m, and more preferably of 1.0 to 8.0 $\mu$m. Furthermore, the variation coefficient of the size distribution is preferably not more than 50 percent, is more preferably not more than 40 percent, and is most preferably not more than 30 percent. The variation coefficient of the size distribution as described herein is a value represented by the formula described below:

(Standard deviation of particle diameter)/(average particle diameter)×100

The matting agent according to the present invention can be incorporated into any layer. In order to accomplish the object of the present invention, the matting agent is preferably incorporated into the layer other than the image forming layer, and is more preferably incorporated into the farthest layer from the support surface.

Addition methods of the matting agent include those in which a matting agent is previously dispersed into a coating composition and is then coated, and prior to the completion of drying, a matting agent is sprayed. When plural matting agents are added, both methods may be employed in combination.

The thermally developable photosensitive material used in the invention is subjected to thermal development to form photographic images, preferably comprising reducible silver source (organic silver salts), silver halide in an amount necessary to exhibit catalytic activity, a hydrazine derivative and a reducing agent, and, optionally, a toning agent restraining silver image tone, which are dispersed in (organic) binder matrix.

The thermally developable photographic materials are stable at ordinary temperatures, and are developed on heating , after exposure, at a high temperature (e.g., 80 to 140° C.), forming silver on heating through oxidation-reduction reaction between an organic silver salt (which functions as an oxidizing agent) and a reducing agent. The oxidation-reduction reaction is catalytically accelerated by silver formed upon exposure to light. Silver produced from the reaction of the organic silver salt in an exposed area gives a black image distinguishable from an unexposed area to perform image formation. This reaction process can proceed without supplying a processing solution such as water from the outside.

The thermally developable photosensitive materials according to the invention have at least an image forming layer on the support. There may be provided the image forming layer alone, but further thereon, at least a light-insensitive layer is preferably provided. To control the amount or wavelength distribution of light transmitting through the image forming layer, a filter layer may be provided on the same side or opposite side to the image forming layer. Further, the image forming layer may contain a dye or pigment. Dyes described in Japanese Application No. 7-11184 are preferred. The image forming layer may be comprised of plural layers and to adjust contrast, the arrangement may be a high speed layer/low speed layer or low speed layer/high sped layer. Various additives may be incorporated into any one of an image forming layer, non-image-forming layer, and other component layer(s). In the thermally developable photosensitive materials used in the invention, there may be employed adjuvants such as a surfactant, an antioxidant, a stabilizing agent, a plasticizer, a UV absorbent and a coating aid.

Image toning agents are preferably incorporated into the thermally developable photosensitive material used in the present invention. Examples of preferred image toning agents are disclosed in Research Disclosure Item 17029, and include the following:

imides (for example, phthalimide), cyclic imides, pyrazoline-5-one, and quinazolinone (for example, succinimide, 3-phenyl-2-pyrazoline-5-on, 1-phenylurazole, quinazoline and 2,4-thiazolidione); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides (for example, N-(dimethylaminomethyl)phthalimide); blocked pyrazoles, isothiuronium derivatives and combinations of certain types of light-bleaching agents (for example, combination of N,N'-hexamethylene(1-carbamoyl-3,5-dimethylpyrazole), 1,8-(3,6-dioxaoctane)bis-(isothiuroniumtrifluoroacetate), and 2-(tribromomethyl-sulfonyl)benzothiazole; merocyanine dyes (for example, 3-ethyl-5-((3-etyl-2-benzothiazolinylidene-(benzothiazolinylidene))-1-methylethylidene-2-thio-2,4-oxazolidinedione); phthalazinone, phthalazinone derivatives or metal salts thereof (for example, 4-(1-naphthyl)phthalazinone, 6-chlorophthalazinone, 5,7-dimethylphthalazinone, and 2,3-dihydro-1,4-phthalaziriedione); combinations of phthalazinone and sulfinic acid derivatives (for example, 6-chlorophthalazinone and benzenesulfinic acid sodium, or 8-methylphthalazinone and p-trisulfonic acid sodium); combinations of phthalazine and phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, naphthoxazine derivatives, benzoxazine-2,4-diones (for example, 1,3-benzoxazine-2,4-dione); pyrimidines and asymmetry-triazines (for example, 2,4-dihydroxypyrimidine), and tetraazapentalene derivatives (for example, 3,6-dimercapto-1,4-diphenyl-1H, 4H-2,3a, 5,6a-tatraazapentalene). Preferred image color control agents include phthalazone or phthalazine.

Antifoggants may be incorporated into the thermally developable photosensitive material to which the present invention is applied. The substance which is known as the most effective antifoggant is a mercury ion. The incorporation of mercury compounds as the antifoggant into photosensitive materials is disclosed, for example, in U.S. Pat. No. 3,589,903. However, mercury compounds are not environmentally preferred. As mercury-free antifoggants, preferred are those antifoggants as disclosed in U.S. Pat. Nos. 4,546,075 and 4,452,885, and Japanese Patent Publication Open to Public Inspection No. 59-57234.

Particularly preferred mercury-free antifoggants are heterocyclic compounds having at least one substituent, represented by —C(X1)(X2)(X3) (wherein X1 and X2 each represent halogen, and X3 represents hydrogen or halogen), as disclosed in U.S. Pat. Nos. 3,874,946 and 4,756,999. As examples of suitable antifoggants, employed preferably are compounds described in paragraph numbers [0062] and [0063] of JP-A No. 9-90550. Furthermore, other suitable antifoggants are disclosed in U.S. Pat. No. 5,028,523, and U.K. Patent Application Nos. 92221383. No. 4, 9300147. No. 7, and 9311790. No. 1.

In the thermally developable photosensitive material of the present invention, employed can be sensitizing dyes described, for example, in JP-A Nos. 63-159841, 60-140335, 63-231437, 63-259651, 63-304242, and 63-15245; U.S. Pat. Nos. 4,639,414, 4,740,455, 4,741,966, 4,751,175, and 4,835,096. Useful sensitizing dyes employed in the present invention are described, for example, in publications described in or cited in Research Disclosure Items 17643, Section IV-A (page 23, December 1978). Particularly, selected can advantageously be sensitizing dyes having the spectral sensitivity suitable for spectral characteristics of light sources of various types of scanners. For example, compounds described in JP-A Nos. 9-34078, 9-54409 and 9-80679 are preferably employed.

EXAMPLES

The present invention will be further described based on examples but embodiments of the invention are by no means limited to these examples.

EXAMPLE 1

Preparation of a Subbed Photographic Support

Both surfaces of a biaxially stretched thermally fixed 100 μm PET film, available on the market, was subjected to corona discharging at 8 w/M$^2$·min. Onto the surface of one side, the subbing coating composition a-1 descried below was applied so as to form a dried layer thickness of 0.8 μm, which was then dried. The resulting coating was designated Subbing Layer A-1. Onto the opposite surface, the subbing coating composition b-1 described below was applied to form a dried layer thickness of 0.8 μm. The resulting coating was designated Subbing Layer B-1.

| Subbing Coating Composition a-1 | |
|---|---|
| Latex solution (solid 30%) of a copolymer consisting of butyl acrylate (30 weight %), t-butyl acrylate (20 weight %) 2-Hydroxyethyl acrylate (25 weight %) | 270 g |
| (C-1) | 0.6 g |
| Hexamethylene-1,6-bis(ethyleneurea) | 0.8 g |
| Water to make | 1 liter |
| **Subbing Coating Composition b-1** | |
| Latex liquid (solid portion of 30%) of a copolymer consisting of butyl acrylate (40 weight %) styrene (20 weight %) glycidyl acrylate (25 weight %) | 270 g |

-continued

| | |
|---|---|
| (C-1) | 0.6 g |
| Hexamethylene-1,6-bis(ethyleneurea) | 0.8 g |
| Water to make | 1 liter |

Subsequently, the surfaces of Subbing Layers A-1 and B-1 were subjected to corona discharging with 8 w/m$^2$·minute. Onto the Subbing Layer A-1, the upper subbing layer coating composition a-2 described below was applied so as to form a dried layer thickness of 0.8 $\mu$m, which was designated Subbing Layer A-2, while onto the Subbing Layer B-1, the upper subbing layer coating composition b-2 was applied so at to form a dried layer thickness of 0.8 $\mu$m, having a static preventing function, which was designated Subbing Upper Layer B-2.

| Upper Subbing Layer Coating Composition a-2 | |
|---|---|
| Gelatin in an amount (weight) to make | 0.4 g/m$^2$ |
| (C-1) | 0.2 g |
| (C-2) | 0.2 g |
| (C-3) | 0.1 g |
| Silica particles (av. size 3 $\mu$m) | 0.1 g |
| Water to make | 1 liter |
| **Upper Subbing Layer Coating Composition b-2** | |
| (C-4) | 60 g |
| Latex solution (solid 20% comprising) (C-5) as a substituent | 80 g |
| Ammonium sulfate | 0.5 g |
| (C-6) | 12 g |
| Polyethylene glycol (average molecular weight of 600) | 6 g |
| Water to make | 1 liter |

(C-1)

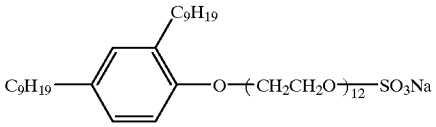

(C-2)

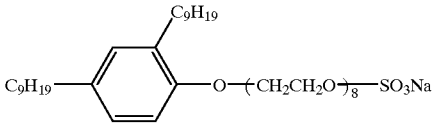

(C-3)

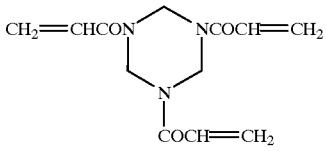

-continued (C-4)

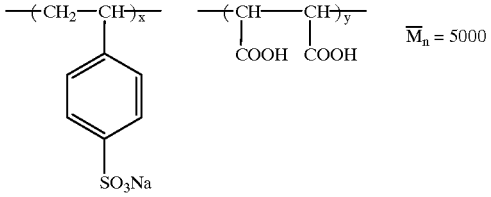

($\overline{M}$n is a number average molecular weight)
x:y = 75:25 (weight ratio)

(C-5)

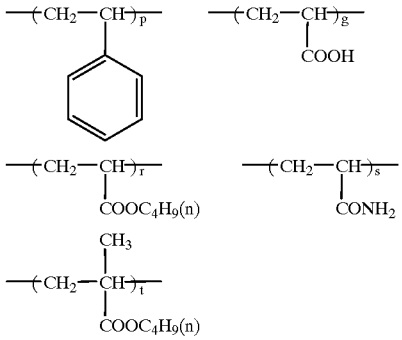

p:g:r:s:t = 40:5:10:5:40 (weight ratio)

(C-6)

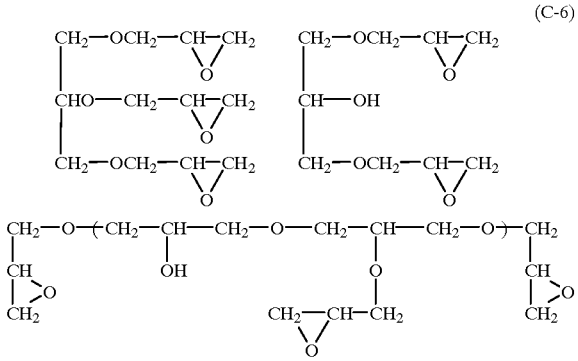

Mixture consisting of the three compounds illustrated above

Preparation of Silver Halide Emulsion A

In 900 ml of deionized water were dissolved 7.5 g of gelatin and 10 mg of potassium bromide. After adjusting the temperature and the pH to 35° C. and 3.0, respectively, 370 ml of an aqueous solution containing 74 g silver nitrate and an equimolar aqueous solution containing potassium bromide, potassium iodide (in a molar ratio of 98 to 2) and $1\times10^{-4}$ mol/mol Ag of rhodium chloride were added over a period of 10 minutes by the controlled double-jet method, while the pAg was maintained at 7.7. Thereafter, 4-hydroxy-6-methyl-1,3,3a,7-tetraazaindene was added and the pH was adjusted to 5 using NaOH. There was obtained cubic silver iodobromide grains having an average grain size of 0.06 $\mu$m, a variation coefficient of the projection area equivalent diameter of 11 percent, and the proportion of the {100} face of 87 percent. The resulting emulsion was flocculated to remove soluble salts, employing a flocculating agent and after desalting, 0.1 g of phenoxyethanol was added and the pH and pAg were adjusted to 5.9 and 7.5, respectively to obtain silver halide emulsion A.

Preparation of Polymer Silver Salt

To an aqueous solution (aqueous dispersion) of a polymer containing 25 mmol of an acid group, as shown in Table 1 was added distilled water to make 300 ml. Further thereto, a 1N sodium hydroxide aqueous solution was added in 15 min. to make a pH 8.7. Then, 7 ml of a 1N phosphoric acid aqueous solution was added, while maintaining the temperature at 30° C. and 0.02 g of N-bromosuccinimide was added with more igorously stirring, thereafter, silver halide emulsion A was added in an amount of 2.5 mmol of silver halide. To this solution was added an aqueous gelatin solution in which 10 g of ossein gelatin and 1 g of polyoxyethylene dodecylphenyl ether (average ethylene unit of 8) were dissolved in 500 ml distilled water; and 25 ml of a 1N nitric acid aqueous solution was added at 30° C. in 30 min., while dispersing with a homogenizer. After completing addition, stirring was further conducted for 30 min. and the resulting dispersion was subjected to ultrafiltration to remove soluble salts until the filtrate reached a conductivity of 30 $\mu$S/cm. Aqueous dispersions containing silver halide/polymer silver salt and having an average particle size of 1 $\mu$m (PG-1 to PG-8) were thus obtained.

Preparation of Organic Silver Salt

Stearic acid of 1.3 g, 0.5 g of arachidic acid, 8.5 g of behenic acid and 300 ml of distilled water were mixed at 90° C. for a period of 15 min. After an aqueous 1N sodium hydroxide was added in 15 min. until reaches a pH of 8.7, the temperature was lowered to 30° C. Next, 7 ml of an aqueous iN phosphoric acid was added and 0.02 g of N-bromosuccinimide was added, then, silver halide emulsion A was added in an amount of 2.5 mmol of silver halide. To this solution was added an aqueous gelatin solution in which 10 g of ossein gelatin and 1 g of polyoxyethylene dodecylphenyl ether (average ethylene unit of 8) were dissolved in 500 ml distilled water; and 25 ml of a 1N nitric acid aqueous solution was added at 30° C. in 30 min., while dispersing with a homogenizer. After completing addition, stirring was further conducted for 30 min. and the resulting dispersion was subjected to ultrafiltration to remove soluble salts until the filtrate reached a conductivity of 30 $\mu$S/cm. An aqueous dispersion containing silver halide/polymer silver salt and having an average particle size of 1 $\mu$m (organic silver salt B) was thus obtained.

Coating of Image Forming Layer

On the subbed support, the following layers were formed to prepare samples. Drying was conducted at 75° C. for a period of 5 min.

Back Side Coating

Back Layer

To an aqueous solution or dispersion containing the following composition, water was added to prepare a coating solution, which was coated and dried to form a backing layer having a coverage described below , on the subbing layer B-2.

| | |
|---|---|
| Gelatin | 7.0 g/m$^2$ |
| Dye-B | 70 mg/m$^2$ |
| Dye-C | 70 mg/m$^2$ |

Dye-B

-continued

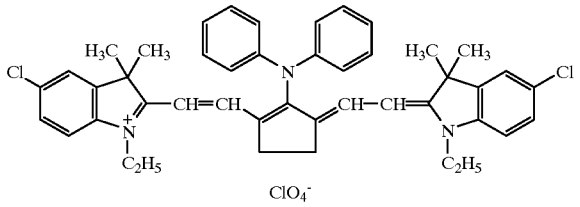

Dye-C

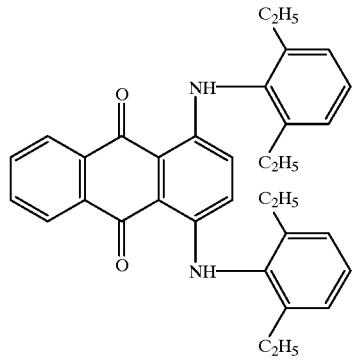

Image Forming Layer

Water was added to an aqueous dispersion containing the following composition to prepare a coating solution. After measuring the silver potential (also denoted as EAg-1) using a silver potentiometer formed of a silver electrode (purity of 99.99% or more) and a reference electrode comprised of Ag/AgCl immersed in a 3M solution and connecting via a 10% $KNO_3$ salt bridge, the coating solution was coated and dried so that the coating amounts were as below.

Organic silver salt (Table 2) of 2.0 g Ag/m$^2$

| | |
|---|---|
| Binder (sum of polymer moiety of polymer silver salt and polyvinyl butyral) | 5.0 g/m$^2$ |
| Silver potential-adjusting agent | (Table 2) |
| Sensitizing dye-1 | 2 mg/m$^2$ |
| Antifoggant-1 pyridinium hydrobriomide perbromide | 0.3 mg/m$^2$ |
| Antifoggant-2 | 1.2 mg/m$^3$ |
| Antifogging-3 2-tribromomethylsulfonyl Quinoline | 120 mg/m$^2$ |
| Phthalazone | 360 mg/m$^2$ |
| Developer A-4 | 1300 mg/m$^2$ |
| Contrast-increasing agent H-1 | 100 mg/m$^2$ |
| Contrast-increasing agent H-2 | 100 mg/m$^2$ |

Sensitizing dye-1

-continued

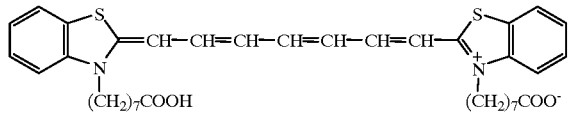

Antifoggant-2

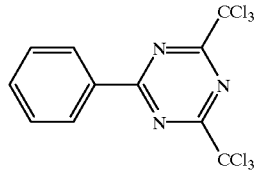

Contrast-increasing agent H-1

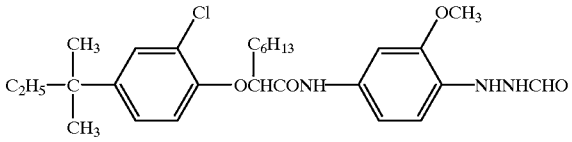

Contrast-increasing agent H-2

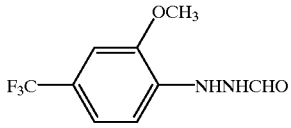

The image forming layer containing a polymeric silver salt was 8 and the image forming layer containing silver behenate was 17 $\mu$m thick.

Surface Protective Layer

To an aqueous solution or dispersion containing the following composition, water was added to prepare a coating solution, which was coated and dried to form a protective layer having the coverage described below, on the image forming layer.

| | |
|---|---|
| Gelatin | 2.0 g/m$^2$ |
| Phthalazinone | 1.0 g/m$^2$ |
| 4-Methylphthalic acid | 0.72 g/m$^2$ |
| Tetrachlorophthalic acid | 0.22 g/m$^2$ |
| Tetrachlorophthalic acid anhydride | 0.5 g/m$^2$ |
| Silica matting agent (av. Size 5 $\mu$m) | 0.5 g/m$^2$ |

Evaluation of Photographic Performance

The thus prepared thermally developable photosensitive material samples were divided two parts. After one part of the samples was allowed to stand at 25° C. and 60% Rh over a period of 24 hrs, each sample was exposed using a laser sensitometer having 780 nm laser light and then subjected to heat development at 130° C. for 25 sec. Using a heated drum, in which exposure and development were conducted in a room conditioned at 60% RH. Obtained images were subjected to densitometry and evaluated with respect to sensitivity denoted as S; fog, denoted as Dmin; and maximum density, denoted as Dmax (photographic characteristic at ordinary temperature). Sensitivity was represented by a relative value of reciprocal of exposure necessary to give a density of 0.3 plus a fog (minimum) density, based on the sensitivity of Sample 1. The angle between the exposed surface and exposing laser light was set to 800. The other part of the samples were allowed to stand at 25° C. and 80% RH over a period of 3 days and thereafter, each sample was evaluated in the same manner as described above (photographic characteristics at high humidity).

Determination of Silver Potential of Photosensitive Material

The thus prepared photosensitive material sample of 10,000 mm$^2$ was cut to pieces of 100 mm$^2$, and all pieces were immersed into 100 ml of water/methanol (70/30) solution maintained at a temperature of 40° C. and contained in a 200 ml beaker and was allowed to stand therein for 60 min. After removing the photosensitive material, the solution maintained at 40° C. was measured with respect to a silver potential (denoted as EAg-2) using the same silver potentiometer as used in the measurement of the silver potential of coating solutions (denoted as EAg-1).

Results thereof are shown in Table 2.

TABLE 1

| Polymer Silver Salt | | |
|---|---|---|
| No. | Polymer | Polymer Fraction* |
| PG-1 | P-1 | |
| PG-2 | P-4 | |
| PG-3 | P-9 | |
| PG-4 | P-13 P-20 | 60/40 |
| PG-5 | P-14 | |
| PG-6 | P-23 | |
| PG-7 | P-25 | |
| PG-8 | P-29 | |

*The polymer fraction represents a mole fraction of an acid group.

TABLE 2

| Sample | Org. Silver | Ad- | EAg-1*2 | EAg-2*3 | Liquid Dispersing | Ord. Temp. | | | High Humidity | | |
|---|---|---|---|---|---|---|---|---|---|---|---|
| No. | Salt | juster*1 | (mV) | (mV) | Medium | Dmin | S | Dmax | Dmin | S | Dmax |
| 1 | B*4 | — | 350 | 400 | Water | 0.25 | 100 | 2.90 | 0.40 | 90 | 2.50 |
| 2 | B | KBr | 120 | 130 | Water | 0.21 | 102 | 3.00 | 0.23 | 100 | 2.95 |
| 3 | B | KBr | −50 | −40 | Water | 0.15 | 80 | 2.50 | 0.18 | 75 | 2.00 |
| 4 | PG-1 | — | 140 | 160 | Water/ methanol (40/60) | 0.20 | 100 | 3.10 | 0.23 | 100 | 3.00 |
| 5 | PG-1 | — | 120 | 140 | Water/ methanol | 0.20 | 100 | 3.10 | 0.22 | 100 | 3.00 |

TABLE 2-continued

| Sample No. | Org. Silver Salt | Ad-juster*1 | EAg-1*2 (mV) | EAg-2*3 (mV) | Liquid Dispersing Medium | Ord. Temp. Dmin | Ord. Temp. S | Ord. Temp. Dmax | High Humidity Dmin | High Humidity S | High Humidity Dmax |
|---|---|---|---|---|---|---|---|---|---|---|---|
| | | | | | (70/30) | | | | | | |
| 6 | PG-1 | — | 100 | 120 | Water | 0.20 | 100 | 3.00 | 0.22 | 100 | 3.00 |
| 7 | PG-2 | — | 120 | 100 | Water | 0.20 | 102 | 3.00 | 0.22 | 100 | 2.95 |
| 8 | PG-3 | — | 130 | 140 | Water | 0.20 | 102 | 3.10 | 0.21 | 100 | 3.00 |
| 9 | PG-4 | — | 120 | 130 | Water | 0.20 | 100 | 3.00 | 0.22 | 102 | 2.95 |
| 10 | PG-5 | — | 150 | 140 | Water | 0.21 | 102 | 3.00 | 0.22 | 100 | 2.95 |
| 11 | PG-6 | — | 90 | 100 | Water | 0.20 | 105 | 3.20 | 0.21 | 103 | 3.10 |
| 12 | PG-7 | — | 100 | 90 | Water | 0.20 | 105 | 3.10 | 0.21 | 105 | 3.10 |
| 13 | PG-8 | — | 120 | 140 | Water | 0.22 | 102 | 3.00 | 0.22 | 100 | 2.95 |

*1Silver potential-adjusting agent
*2Silver potential of coating solution (EAg-1)
*3Silver potential of photosensitive material (EAg-2)
*4Organic silver salt B
*5Solution was coagulated.

As can be seen from Table 2, it was proved that the adjustment of the silver potential to the range as claimed in the invention led to prevention of fog increase in an atmosphere at a high humidity. Coating by use of water solvent became feasible, which was favorable in terms of the environment protection and manufacturing cost. The use of polymeric silver salts not only improved storage stability of the photosensitive materials but also led to a thinner image forming layer.

EXAMPLE 2

Preparation of a Subbed Photographic Support

Both surfaces of a biaxially stretched thermally fixed 175 μm PET film, available on the market, were subjected to corona discharging at 8 w/m$^2$ min. Onto the surface of one side, the subbing coating composition c descried below was applied so as to form a dried layer thickness of 0.8 μm, which was then dried. The resulting coating was designated Subbing Layer C. Onto the opposite surface, the subbing coating composition d-1 described below was applied to form a dried layer thickness of 0.8 μm. The resulting coating was designated Subbing Layer D-1.

| Subbing Layer Coating Composition c | |
|---|---|
| Polyester copolymer dispersion PES Resin A-515GB (available from TAKAMATSU YUSHI Co. Ltd.) | 200 ml |
| Polystyrene fine particle (av. 0.2 μm) | 50 g |
| Surfactant (1 wt %) | 20 ml |
| Water to make | 1 liter |
| **Subbing Layer Coating Composition d-1** | |
| Styrene-butadiene copolymer aqueous Dispersion (styrene/butadiene/itaconic acid Itaconic acid = 47/50/3, conc. 30 wt %) | 200 ml |
| Polystyrene fine particle (av. 2.5 μm) | 0.1 g |
| Water to make | 1 liter |

Subsequently, the surfaces of Subbing Layer D-1 was subjected to corona discharging with 8 w/m$^2$·minute. Onto the Subbing Layer, the following subbing layer coating composition d-2 described below was applied so as to form a dried layer thickness of 0.8 μm, having a static preventing function, which was designated Subbing Upper Layer D-2.

| Subbing Layer Coating Composition d-2 | |
|---|---|
| Inert gelatin | 10 g |
| Aqueous dispersion of tin oxide-antimony oxide, described in JP-A 61-20033 (40 wt %) | 40 g |
| Silica particles (av. size 3 μm) | 0.1 g |
| Water to make | 1 liter |

Preparation of Silver Halide Emulsion B

In 900 ml of deionized water were dissolved 7.5 g of gelatin and 10 mg of potassium bromide. After adjusting the temperature and the pH to 35° C. and 3.0, respectively, 370 ml of an aqueous solution containing 74 g silver nitrate and an equimolar aqueous solution containing potassium bromide, potassium iodide (in a molar ratio of 98 to 2) and $1\times10^{-4}$ mol/mol Ag of iridium chloride were added over a period of 10 minutes by the controlled double-jet method, while the pAg was maintained at 7.7. Thereafter, 4-hydroxy-6-methyl-1,3,3a,7-tetraazaindene was added and the pH was adjusted to 5 using NaOH. There was obtained cubic silver iodobromide grains having an average grain size of 0.06 μm, a variation coefficient of the projection area equivalent diameter of 11 percent, and the proportion of the {100} face of 87 percent. The resulting emulsion was flocculated to remove soluble salts, employing a flocculating agent and after desalting, 0.1 g of phenoxyethanol was added and the pH and pAg were adjusted to 5.9 and 7.5, respectively to obtain silver halide emulsion B.

Preparation of Polymer Silver Salt

Aqueous dispersions containing silver halide/polymer silver salt and having an average particle size of 1 μm were prepared in a manner similar to Example 1, except that silver halide emulsion A was replaced by silver halide emulsion B and aqueous polymer solutions (or aqueous dispersions) were varied as shown in Table 2.

Preparation of Organic Silver Salt

Aqueous dispersions containing silver halide/organic silver salt (B-2) and having an average particle size of 1 μm were prepared in a manner similar to Example 1, except that silver halide emulsion A was replaced by silver halide emulsion B.

Coating of Image Forming Layer

On the support subbed with C, the following layers were formed to prepare samples. Drying was conducted at 75° C. for a period of 5 min.

Image Forming Layer

Water was added to an aqueous dispersion containing the following composition to prepare a coating solution. After measuring the silver potential (also denoted as EAg-1) using a silver potentiometer formed of a silver electrode (purity of 99.99% or more) and a reference electrode comprised of Ag/AgCl immersed in a 3M solution and connecting via a 10% KNO3 salt bridge, the coating solution was coated.

Organic silver salt (Table 3) of 1.6 g Ag/m$^2$

| | |
|---|---|
| Binder (sum of polymer moiety of polymer silver salt and copoly(styrene-butadiene) latex9 | 6.0 g/m$^2$ |
| Sensitizing dye-1 | 1.8 mg/m$^2$ |
| Antifoggant-1 pyridinium hydrobriomide perbromide | 0.27 mg/m$^2$ |
| Antifoggant-2 | 1.0 mg/m$^2$ |
| Antifoggant-3 2-tribromomethylsulfonyl Quinoline | 100 mg/m$^2$ |
| Phthalazone | 330 mg/m$^2$ |
| Developer A-4 | 1000 mg/m$^2$ |

The image forming layer containing a polymer silver salt was 7 μm thick and the image forming layer containing silver behenate was 15 μm thick.

Surface Protective Layer

To an aqueous solution or dispersion containing the following composition, water was added to prepare a coating solution.

| | |
|---|---|
| Gelatin | 2.0 g/m$^2$ |
| Phthalazinone | 1.0 g/m$^2$ |
| 4-Methylphthalic acid | 0.70 g/m$^2$ |
| Tetrachlorophthalic acid | 0.20 g/m$^2$ |
| Tetrachlorophthalic acid anhydride | 0.47 g/m$^2$ |
| 1,3-bis(vinylsulfonyl)-2-hydroxypropane | 0.022 g/m$^2$ |
| Silica matting agent (av. Size 2 μm) | 0.5 g/m$^2$ |
| Silica matting agent (av. Size 5 μm) | 0.3 g/m$^2$ |

Determination of Silver Potential of Photosensitive Material

The thus prepared photosensitive material sample of 10,000 MM$^2$ was cut to pieces of 100 mm$^2$, and all pieces were immersed into 100 ml of water/methanol (70/30) solution maintained at a temperature of 40° C. and contained in a 200 ml beaker and was allowed to stand therein for 60 min. After removing the photosensitive material, the solution maintained at 40° C. was measured with respect to a silver potential (denoted as EAg-2) using the same silver potentiometer as used in the measurement of the silver potential of coating solutions (denoted as EAg-1).

Evaluation of Photographic Performance

Each photosensitive material samples were evaluated with respect to photographic performance in the same manner as in Example 1. Results thereof are shown in Table 3.

TABLE 3

| Sample | Polymer Silver Salt | Silver potential (mV) | | Ord. Temp. | | | High Humidity | | | |
|---|---|---|---|---|---|---|---|---|---|---|
| No. | Polymer | EAg-1 | EAg-2 | Dmin | S | Dmax | Dmin | S | Dmax | Remark |
| 15 | B-2 | 350 | 400 | 0.23 | 100 | 2.80 | 0.38 | 70 | 2.20 | Comp. |
| 16 | P-1 | 100 | 120 | 0.20 | 100 | 3.00 | 0.22 | 95 | 2.90 | Inv. |
| 17 | P-14 | 150 | 170 | 0.21 | 102 | 3.00 | 0.22 | 100 | 2.95 | Inv. |
| 18 | P-23 | 90 | 90 | 0.20 | 105 | 3.20 | 0.21 | 103 | 3.10 | Inv. |
| 19 | P-29 | 120 | 110 | 0.21 | 103 | 3.10 | 0.22 | 100 | 3.00 | Inv. |

B-2: Organic silver salt B-2

As can be seen from Table 3, thermally developable photosensitive materials relating to the invention exhibited superior storage stability, even when being stocked in an atmosphere at high humidity. Further, the use of polymer silver salts led to a thinner image forming layer, while maintaining superior storage stability.

EXAMPLE 3

Preparation of Photographic Support

Both surfaces of a blue-tinted (density of 0.170, measured with a densitometer PDA-65, available from Konica Corp.) 175 μm thick PET film were subjected to corona discharging at 8 w/m$^2$·min.

Preparation of Silver Halide Emulsion C

Al-solution

| | |
|---|---|
| Phenylcarbamoyl-modified gelatin | 88.3 g |
| Compound (A)* (aq. 10% Methanol solution) | 10 ml |
| Potassium bromide | 0.32 g |
| Water to make | 5429 ml |
| B1-solution | |
| 0.67N Aqueous silver nitrate solution | 2635 ml |
| C1-solution | |
| Potassium bromide | 51.55 g |
| Potassium iodide | 1.47 g |
| Water to make | 660 ml |
| D1-solution | |
| Potassium bromide | 154.9 g |
| Potassium iodide | 4.41 g |
| Iridium chloride (1% aq. Solution) | 0.93 ml |
| Water to make | 1982 ml |

-continued

| | |
|---|---|
| E1-solution | |
| 0.4N aqueous potassium bromide solution in amount necessary to adjust silver potential | |
| F1-solution | |
| Potassiumhydroxide | 0.71 g |
| Water to make | 20 ml |
| G1-solution | |
| Aqueous 56% acetic acid solution | 18 ml |
| H1-solution | |
| Anhydrous sodium carbonate | 1.72 g |
| Water to make | 151 ml |

*$HO(CH_2CH_2O)n—[C(CH_3)CH_2O]_{17}—(CH_2CH_2O)mH$ (m + n = 5 – 7)

To solution Al with stirring by a mixing stirrer described in JP-B 58-58288 and 58-58289, 1/4 of solution B1 and total of solution Cl were simultaneously added in 4 min. 45 sec to form nucleus grains, while the temperature and the pAg were maintained at 45° C. and 8.09. After 1 min., solution F1 was added thereto and stirred for 6 min. and then, ¾ of solution B1 and total of solution D1 were simultaneously added in 4 min. 15 sec, while the temperature and the pAg were maintained at 45° C. and 8.09. after stirring for 5 min., the temperature was lowered to 40° C. and solution G1 was further added thereto to coagulate the emulsion. Remaining 2,000 ml precipitating solution, supernatant was removed and 10 lit. Of water was added. After stirring, the silver halide emulsion was coagulated. Remaining 1,500 ml precipitating solution, supernatant was removed and 10 lit. water was again added. After stirring, the silver halide emulsion was coagulated. Remaining 1,500 ml precipitating solution, supernatant was removed, solution H1 was added thereto, then, the temperature was raised to 60° C. and further stirred for 120 min. Finally, the pH was adjusted to 5.8 and water was added to make 1161 g per mol of silver halide. Photosensitive silver halide emulsion C was thus obtained, comprising monodisperse cubic silver iodobromide grains having an average grain size of 0.058 μm, a variation coefficient of the projection area equivalent diameter of 12 percent, and the proportion of the {100} face of 92 percent.

Preparation of Photosensitive Dispersion C

In 4720 ml water were dissolved 217.6 g of behenic acid, 28.2 g of arachidic acid and 6.4 g of stearic acid at 90° C. The, after adding 93.3 ml of 4N aqueous sodium hydroxide solution with stirring and the solution was cooled to a temperature of 40° C. to obtain an aqueous organic acid sodium salt solution. To the solution were added 45.3 g of the silver halide emulsion C obtained above (equivalent to 0.038 mol silver) and 450 ml water and stirring further continued for 5 min., while maintained at a temperature of 40° C. Subsequently, 702.6 ml of 1M aqueous silver nitrate solution was added in 2 min. and stirring continued further for 10 min., then, the reaction mixture was filtered to remove aqueous soluble salts. Thereafter, washing with deionized water and filtration were repeated until the filtrate reached a conductivity of 2 μS/cm, and after subjecting to centrifugal dehydration, the reaction product was dried with heated air at 40° C. until no reduction in weight was detected to obtain powdery organic silver salt.

In 1457 g methyl ethyl ketone was dissolved 14.57 g of polyvinyl butyral powder (Butvar B-79, available from Monsanto Corp.) and further thereto was gradually added 500 g of the powdery organic silver salt with stirring by a dissolver DISPERMAT type CA-40M (available from VMA-GETZMANN Corp.). Thereafter, the mixture was dispersed using a pressure type homogenizer GM-2 (available from STM Corp.) to obtain photosensitive emulsion dispersing solution C.

Preparation of Photosensitive Dispersion

To an aqueous solution (or aqueous dispersion) of a polymer containing 0.7 mol of acid group, as shown in Table 4, was added water and the pH was adjusted to 5.9 with aqueous 1.5M sodium hydroxide solution and concentrated nitric acid solution to obtain 5,000 ml solution. Further thereto were added 45.3 g of silver halide emulsion C and 450 ml water, while maintaining a temperature at 30° C. and stirring further continued for 5 min. Subsequently, 702.6 ml of 1M aqueous silver nitrate solution was added in 2 min. and stirring continued further for 10 min., then, the reaction mixture was filtered to remove aqueous soluble salts. Thereafter, washing with deionized water and filtration were repeated until the filtrate reached a conductivity of 2 μS/cm, and after subjecting to centrifugal dehydration, the reaction product was dried with heated air at 40° C. until no reduction in weight was detected to obtain powdery organic silver salt.

In 1457 g methyl ethyl ketone was dissolved 14.57 g of polyvinyl butyral powder (Butvar B-79, available from Monsanto Corp.) and further thereto was gradually added 500 g of the powdery organic silver salt with stirring by a dissolver DISPERMAT type CA-40M (available from VMA-GETZMANN Corp.). Thereafter, the mixture was dispersed using a pressure type homogenizer GM-2 (available from STM Corp.) to obtain photosensitive emulsion dispersing solutions D-1 to D-4.

Preparation of Photosensitive Layer (Image Forming layer) Coating Solution

To 100 g methyl ethyl ketone was added 500 g of each of the photosensitive dispersions and stirred, while maintaining a temperature at 21° C. Thereafter, the following addenda were added in an inert gas atmosphere to prepare a coating solution for a photosensitive layer. Pyridinium hydrobomide perbromide (PHP, 0.45 g) was added and stirred for 1 hr. Further thereto was added calcium bromide (3.25 ml of 10% methanol solution) and stirred for 30 min. Then, a mixture solution of infrared sensitizing dye 1,4-chloro-2-benzoylbenzoic acid and supersensitizer,5-methyl-2-mercaptobenzimidazole (a mixture ratio of 1:250:20, and 7 ml of 0.1% methanol solution of the sensitizing dye) were added and stirred for 1 hr. and the temperature was lowered to 13° C. and further stirred for 30 min. Polyvinyl butyral powder (Butvar B-79, available from Monsanto Corp.) was added and dissolved, while maintaining a temperature at 13° C. and the following addenda were successively added to obtain a photosensitive layer coating solution.

| | |
|---|---|
| Developer [1,1-bis(2-hydroxy-3,5-dimethylphenyl)-2-methylpropane] | 15 g |
| Desmodu N3300 (aliphatic isocyanate, available from Movey Corp.) | 1.10 g |
| Phthalazine | 1.5 g |
| Tetrachlorophthalic acid | 0.5 g |
| 4-Methylphthalic acid | 0.5 g |

Preparation of Coating solution for Upper Protective Layer

To 865 g of methyl ethyl ketone were added with stirring 96 g of cellulose acetate-butylate (CAB171-15, available from Eastman Chemical Co.) and 4.5 g of polymethyl methacrylate (Paraloid A-21, available from Rohm & Haas Corp.). Further thereto were added and dissolved 1.5 g of 1,3-bis(vinylsulfonyl)-2-hydroxypropane, 1.0 g of benzotriazole and 1.0 g of fluorinated surfactant (Surflon KH40, available from ASAHI Glass Co. Ltd.).

Preparation of Coating solution for Lower Protective Layer

To 665 g of methyl ethyl ketone were added with stirring 65 g of polyvinyl butyral powder (Butvar B-79, available from Monsanto Corp.) and 1.5 g of polymethyl methacrylate (Paraloid A-21, available from Rohm & Haas Corp.). Further thereto were added and dissolved 4.5 g of 1,3-bis(vinylsulfonyl)-2-hydroxypropane, 3.0 g of benzotriazole and 1.6 g of fluorinated surfactant (Surflon KH40, available from ASAHI Glass Co. Ltd.).

Photosensitive Layer-Side Coating

The thus prepared coating solutions of a photosensitive layer, lower protective layer and upper protective layer were simultaneously coated on a support and dried at 75° C. for 5 min. to prepare a thermally developable photosensitive material comprising a support having thereon a 7 μm thick photosensitive layer, a 1 μm thick lower protective layer and a 1 μm thick upper protective layer in this order. In this case, the silver coating amount was 1.6 g/m$^2$ and the ratio of organic silver salt /(organic silver salt+polyvinyl butyral) was 70% by weight.

Preparation of Backing Coat Composition

To 830 g of methyl ethyl ketone, 84.2 g of cellulose acetate-butylate (CAB381-20, available from Eastman Chemical Co.) and 4.5 g of polyester resin (Vitel PE2200B, available from Bostic Corp.) was added with stirring and dissolved therein. To the resulting solution was added 0.30 g of infrared dye 1 (which was the same as used in the photosensitive layer described later) and 4.5 g fluorinated surfactant (Surflon KH40, available from ASAHI Glass Co. Ltd.) and 2.3 g fluorinated surfactant (Megafag F120K, available from DAINIPPON INK Co. Ltd.) which were dissolved in 43.2 g methanol, were added thereto and stirred until being dissolved. Then, 75 g of silica (Siloid 64×6000, available from W. R. Grace Corp.), which was dispersed in methyl ethyl ketone in a concentration of 1 wt % using a dissolver type homogenizer, was further added thereto with stirring to obtain a coating composition for backing layer.

Coating of Backing Layer

The thus prepared coating composition for a backing layer was coated by an extrusion coater and dried so as to have dry thickness of 3.5 μm and dried at a dry-bulb temperature of 100° C. and a wet-bulb temperature of 10° C. over a period of 5 min.

Thus prepared photosensitive materials each had a solvent content of 130 mg/m$^2$.

Determination of Silver Potential of Photosensitive Material

The thus prepared photosensitive material sample of 10,000 mm$^2$ was cut to pieces of 100 mm$^2$, and all pieces were immersed into 100 ml of water/methanol (70/30) solution maintained at a temperature of 40° C. and contained in a 200 ml beaker and was allowed to stand therein for 60 min. After removing the photosensitive material, the solution maintained at 40° C. was measured with respect to a silver potential (denoted as EAg-2) using the same silver potentiometer as used in the measurement of the silver potential of coating solutions (denoted as EAg-1).

Evaluation of Photographic Performance

Each photosensitive material samples were evaluated with respect to photographic performance in the same manner as in Example 1. Results thereof are shown in Table 4.

TABLE 4

| Sample | Photosensitive Dispersion | | EAg-2 | Ord. Temp. | | | High Humidity | | | |
|---|---|---|---|---|---|---|---|---|---|---|
| No. | No. | Polymer | (mV) | Dmin | S | Dmax | Dmin | S | Dmax | Remark |
| 20 | C | — | 350 | 0.23 | 100 | 2.80 | 0.32 | 80 | 2.40 | Comp. |
| 21 | D-1 | P-1 | 100 | 0.21 | 105 | 3.00 | 0.22 | 103 | 2.90 | Inv. |
| 22 | D-2 | P-13 | 120 | 0.21 | 107 | 3.02 | 0.22 | 104 | 2.92 | Inv. |
| 23 | D-3 | P-25 | 110 | 0.20 | 112 | 3.21 | 0.21 | 110 | 3.16 | Inv. |
| 24 | D-4 | P-29 | 90 | 0.20 | 110 | 3.20 | 0.21 | 108 | 3.15 | Inv. |

As can be seen from Table 4, the inventive samples exhibited superior storage stability even when allowed to stand in a high humid atmosphere; and even though the photosensitive layer (image forming layer) was a thin layer of 7 μm, superior photographic performance was obtained.

Disclosed embodiments can be varied by a skilled person without departing from the spirit and scope of the invention.

Infrared sensitizing dye 1

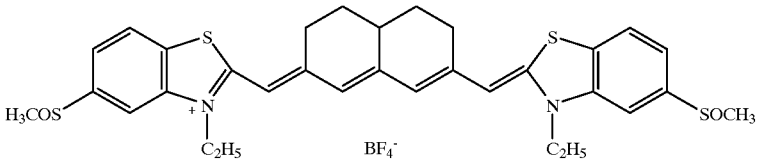

Infrared dye 1

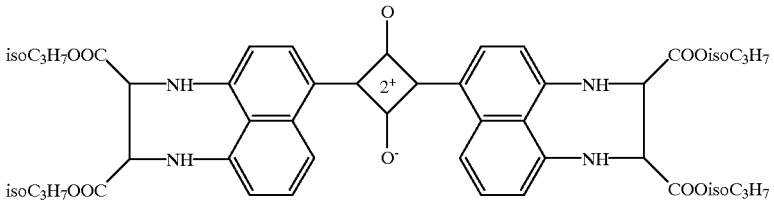

Surfactant A

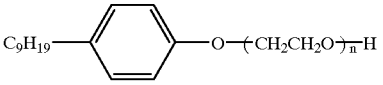

$n = 8.5$

What is claimed is:

1. A thermally developable photosensitive material comprising a support, an image forming layer containing an organic silver salt and optionally provided on the side of the image forming layer, a component layer, wherein at least one of the image forming layer and the component layer contains photosensitive silver halide grains; and after 10,000 $mm^2$ of the thermally developable photosensitive material is immersed in 100 ml of a liquid dispersing medium maintained at a temperature of 40° C. for a period of 60 min., the immersed photosensitive material is removed therefrom and the remaining liquid dispersing medium exhibits a silver potential of not more than 200 mV, in which at least 30% by weight of the liquid dispersing medium is accounted for by water, and wherein the organic silver salt is a silver salt of a polymer represented by the following formula (1):

—(A)a—(B)b— Formula (1)

wherein A is a repeating unit derived from an ethylenically unsaturated monomer containing a carboxy group; B is a repeating unit derived from an ethylenically unsaturated monomer except for A; a and b represent contents of A and B, respectively, a is 5 to 95% by weight and b is 5 to 95%, provided that the sum of a and b is 100%.

2. The thermally developable photosensitive material of claim 1, wherein at least one of the image forming layer and the component layer contains a reducing agent or a precursor thereof.

3. The thermally developable photosensitive material of claim 1, wherein the image forming layer is formed by coating a coating solution for the image forming layer; at least 30% by weight of a liquid dispersing medium contained in the coating solution being water and the coating solution exhibiting a silver potential of not more than 200 mV.

4. The thermally developable photosensitive material of claim 1, wherein the image forming layer is formed by coating a coating solution of the image forming layer and drying it, at least 30% by weight of a liquid medium of the coating solution of the image forming layer being accounted for by an organic solvent.

5. The thermally developable photosensitive material of claim 1, wherein in the silver salt of the polymer, at least 95% of the acid group of the polymer form a silver salt.

6. The thermally developable photosensitive material of claim 1, wherein the image forming layer contains the silver salt of a polymer represented by the following formula (1) in an amount of not less than 50% by weight of the image forming layer and the image forming layer further containing a binder in an amount of less than 50% by weight of the image forming layer.

7. The thermally developable photosensitive material of claim 6, wherein the thickness of the image forming layer is 1 to 10 $\mu$m.

8. The thermally developable photosensitive material of claim 1, wherein the organic silver salt is a silver salt of a polymer obtained by polyaddition of a carboxy-containing dihydric compound and a diisocyanate compound.

9. A method for preparing a thermally developable photosensitive material comprising a support, an image forming layer, and optionally provided on the side of the image forming layer, a component layer, in which at least one of the image forming layer and the component layer contains photosensitive silver halide grains, the method comprising:

coating a coating solution to form an image forming layer wherein the coating solution comprises an organic silver salt and a liquid dispersing medium, at least 30% by weight of the liquid dispersing medium being water, wherein the organic silver salt is a silver salt of a polymer represented by the following formula (1):

—(A)a—(B)b— wherein A is a repeating unit derived from an ethylenically unsaturated monomer containing a carboxy group; B is a repeating unit derived from an ethylenically unsaturated monomer except for A; a and b represent contents of A and B, respectively, a is 5 to 95t by weight and b is 5 to 95%, provided that the sum of a and b is 100%.

10. The method of claim 9 wherein the coating solution exhibits a silver potential of not more than 200 mV.

* * * * *